United States Patent [19]

Cowles

[11] Patent Number: 4,539,960

[45] Date of Patent: Sep. 10, 1985

[54] FUEL PRESSURE REGULATOR

[75] Inventor: Warren H. Cowles, Bloomfield Hills, Mich.

[73] Assignee: Colt Industries Operating Corp, New York, N.Y.

[21] Appl. No.: 378,264

[22] Filed: May 14, 1982

[51] Int. Cl.[3] ..... F02M 31/00

[52] U.S. Cl. ..... 123/463; 123/516; 123/472

[58] Field of Search ..... 123/585, 531, 532, 516, 123/518, 514, 463, 472; 251/61.5, 127, 83; 137/DIG. 2, DIG. 8

[56] References Cited

U.S. PATENT DOCUMENTS

| | | | |
|---|---|---|---|
| 4,205,643 | 6/1980 | Vidal | 123/514 |
| 4,257,378 | 3/1981 | Bascle | 123/514 |
| 4,341,195 | 7/1982 | Bowler | 123/516 |
| 4,342,443 | 8/1982 | Wakeman | 123/472 |

FOREIGN PATENT DOCUMENTS

| | | | |
|---|---|---|---|
| 2905640 | 8/1979 | Fed. Rep. of Germany | 123/463 |

*Primary Examiner*—Carl Stuart Miller

*Attorney, Agent, or Firm*—Walter Potoroka, Sr.

[57] ABSTRACT

A fuel pressure regulator is shown as having two distinct and variable chambers sharing, as a common wall therebetween, a pressure responsive diaphragm which controls the position of a throttle valve actuator depending on the pressure differential existing across the diaphragm with such pressure differential being reflective of the pressure differential existing as from the magnitude of the pressure of the unmetered fuel to the magnitude of the pressure of the metered fuel; the throttle valve actuator serves to further open a fuel throttling valve or permit such fuel throttling valve to further close as to maintain the magnitude of the pressure of the unmetered fuel at a selected regulated magnitude.

7 Claims, 1 Drawing Figure

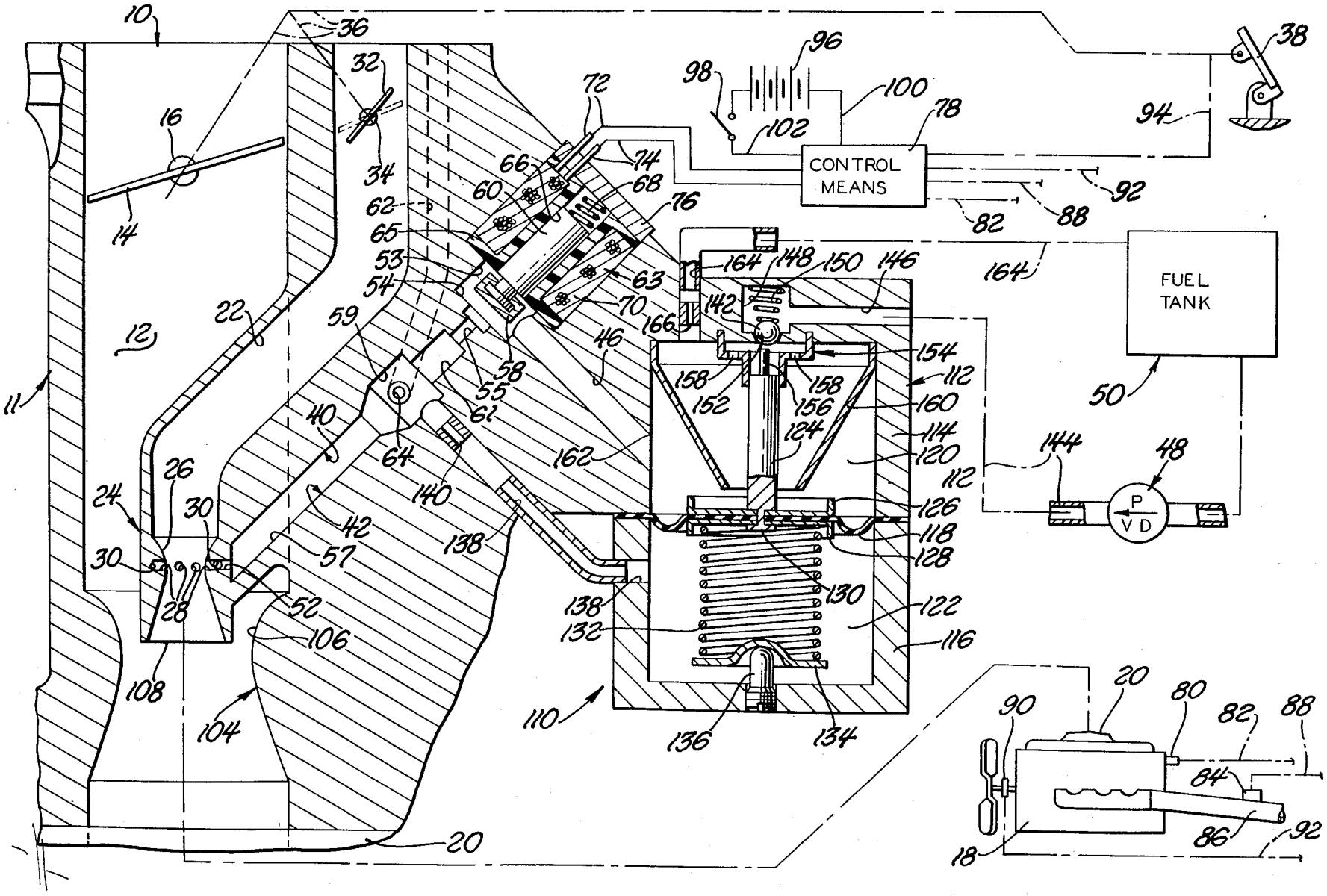
FUEL TANK
CONTROL MEANS
P
V D

FUEL PRESSURE REGULATOR

FIELD OF INVENTION

This invention relates generally to fuel pressure regulators and more particularly pressure regulators employable with fuel injection systems and apparatus for metering fuel flow to an associated combustion engine.

BACKGROUND OF THE INVENTION

Even though the automotive industry has over the years, if for no other reason than seeking competitive advantages, continually exerted efforts to increase the fuel economy of automotive engines, the gains continually realized thereby have been deemed by various levels of government as being insufficient. Further, such levels of government have also arbitrarily imposed regulations specifying the maximum permissible amounts of carbon monoxide (CO), hydrocarbons (HC) and oxides of nitrogen ($NO_x$) which may be emitted by the engine exhaust gases into the atmosphere.

Unfortunately, generally, the available technology employable in attempting to attain increases in engine fuel economy is contrary to that technology employable in attempting to meet the governmentally imposed standards on exhaust emissions.

For example, the prior art in trying to meet the standards for $NO_x$ emissions has employed a system of exhaust gas recirculation whereby at least a portion of the exhaust gas is reintroduced into the cylinder combustion chamber to thereby lower the combustion temperature therein and consequently reduce the formation of $NO_x$.

The prior art has also proposed the use of engine crankcase recirculation means whereby the vapors which might otherwise become vented to the atmosphere are introduced into the engine combustion chambers for further burning.

The prior art has also proposed the use of fuel metering means which are effective for metering a relatively overly rich (in terms of fuel) fuel-air mixture to the engine combustion chamber means as to thereby reduce the creation of $NO_x$ within the combustion chamber. The use of such overly rich fuel-air mixtures results in a substantial increase in CO and HC in the engine exhaust which, in turn, requires the supplying of additional oxygen, as by an associated air pump, to such engine exhaust in order to complete the oxidation of the CO and HC prior to its delivery into the atmosphere.

The prior art has also heretofore proposed employing the retarding of the engine ignition timing as a further means for reducing the creation of $NO_x$. Also, lower engine compression ratios have been employed in order to lower the resulting combustion temperature within the engine combustion chamber and thereby reduce the creation of $NO_x$. In this connection the prior art has employed what is generally known as a dual bed catalyst. That is, a chemically reducing first catalyst is situated in the stream of exhaust gases at a location generally nearer the engine while a chemically oxidizing second catalyst is situated in the stream of exhaust gases at a location generally further away from the engine and downstream of the first catalyst. The relatively high concentrations of CO resulting from the overly rich fuel-air mixture are used as the reducing agent for $NO_x$ in the first catalyst while extra air supplied (as by an associated pump) to the stream of exhaust gases, at a location generally between the two catalysts, serves as the oxidizing agent in the second catalyst. Such systems have been found to have various objections in that, for example, they are comparatively very costly requiring additional conduitry, air pump means and an extra catalyst bed. Further, in such systems, there is a tendency to form ammonia which, in turn, may or may not be reconverted to $NO_x$ in the oxidizing catalyst bed.

The prior art has also proposed the use of fuel metering injection means for eliminating the usually employed carbureting apparatus and, under superatmospheric pressure, injecting the fuel through individual nozzles directly into the respective cylinders of a piston type internal combustion engine. Such fuel injection systems, besides being costly, have not proven to be generally successful in that the system is required to provide metered fuel flow over a very wide range of metered fuel flows. Generally, those prior art injection systems which are very accurate at one end of the required range of metered fuel flows, are relatively inaccurate at the opposite end of that same range of metered fuel flows. Also, those prior art injection systems which are made to be accurate in the mid-portion of the required range of metered fuel flows are usually relatively inaccurate at both ends of that said range. The use of feedback means for altering the metering characteristics of such prior art fuel injection systems has not solved the problem of inaccurate metering because the problem usually is intertwined within such factors as: effective aperture area of the injector nozzle; compatative movement required by the associated nozzle pintle or valving member; inertia of the nozzle valving member; and nozzle "cracking" pressure (that being the pressure at which the nozzle opens). As should be apparent, the smaller the rate of metered fuel flow desired, the greater becomes the influence of such factors thereon.

It is now anticipated that the said various levels of government will be establishing even more stringent exhaust emission limits of, for example, 1.0 gram/mile of $NO_x$ (or even less).

The prior art, in view of such anticipated requirements with respect to $NO_x$, has suggested the employment of a "three-way" catalyst, in a single bed, within the stream of exhaust gases as a means of attaining such anticipated exhaust emission limits. Generally, a "three-way" catalyst is a single catalyst, or catalyst mixture, which catalyzes the oxidation of hydrocarbons and carbon monoxide and also the reduction of oxides of nitrogen. It has been discovered that a difficulty with such a "three-way" catalyst system is that if the fuel metering is too rich (in terms of fuel), the $NO_x$ will be reduced effectively but the oxidation of CO will be incomplete; if the fuel metering is too lean, the CO will be effectively oxidized but the reduction of $NO_x$ will be incomplete. Obviously, in order to make such a "three-way" catalyst system operative, it is necessary to have very accurate control over the fuel metering function of associated fuel metering supply means feeding the engine. As hereinbefore described, the prior art has suggested the use of fuel injection means, employing respective nozzles for each engine combustion chamber, with associated feedback means (responsive to selected indicia of engine operating conditions and parameters) intended to continuously alter or modify the metering characteristics of the fuel injection means. However, as also hereinbefore indicated, such fuel injection systems have not proven to be successful.

It has also heretofore been proposed to employ fuel metering means, of a carbureting type, with feedback means responsive to the presence of selected constituents comprising the engine exhaust gases. Such feedback means were employed to modify the action of a main metering rod of a main fuel metering system of a carburetor. However, tests and experience have indicated that such a prior art carburetor and such a related feedback means can never provide the degree of accuracy required in the metering of fuel to an associated engine as to assure meeting, for example, the said anticipated exhaust emission standards.

It is believed that many of such prior art proposals and apparatus would, at least, have significantly improved operation if more accurate and responsive fuel pressure regulator means were employed in combination therewith.

Accordingly, the invention as disclosed, described and claimed is directed, primarily, to the solution of such and other related and attendant problems of the prior art.

According to the invention a fuel pressure regulator comprises two distinct and variable chambers sharing a common wall therebetween, wherein said common wall comprises pressure responsive movable diaphragm means, a throttle valve for controlling the flow of fuel into a first of said two distinct chambers, first passage means leading from said first of said two distinct chambers to associated fuel metering means, a throttle valve actuator operatively connected to said diaphragm means and effective upon being moved to either further open said throttle valve or permit said throttle valve to further close, resilient means operatively urging said throttle valve actuator to move in a direction which would result in said throttle valve being further opened, and second passage means leading from the second of said two distinct chambers to a source of a reference pressure as to cause said second of said two distinct chambers to be at a magnitude reflective of said reference pressure.

Various general and specific objects, advantages and aspects of the invention will become apparent when reference is made to the following detailed description considered in conjunction with the accompanying drawings.

BRIEF DESCRIPTION OF THE DRAWINGS

In the drawings wherein for purposes of clarity certain details and/or elements may be omitted, the single drawing FIGURE illustrates the preferred embodiment of the invention, shown in cross-section, along with related structure some of which is illustrated in cross-section while other portions are illustrated diagrammatically or schematically.

DETAILED DESCRIPTION OF THE PREFERRED EMBODIMENT

Referring now in greater detail to the drawing, a fuel injection apparatus and system 10 is illustrated as comprising an induction body or housing means 11 having main induction passage means 12 wherein a throttle valve 14 is situated and carried as by a rotatable throttle shaft 16 for rotation therewith thereby variably restricting the flow of air through the induction passage means 12 and into the engine 18 as via associated engine intake manifold means 20. If desired, suitable air cleaner means may be provided as to generally encompass the inlet of induction passage means 12. Second or separate induction passage means 22 is also provided in housing means 11 as for the passage therethrough of idle engine operation air flow. As depicted, the downstream portion of induction passage means 22 communicates as with fuel discharge nozzle means 24 which preferably comprises a venturi-like fuel atomizing portion 26 provided with fuel discharge port means comprised as of a plurality of discharge ports 28 communicating with an annulus 30. An idle air flow valve 32, situated in auxiliary induction passage 22, may be carried by related rotatable shaft means 34 for pivotal rotation therewith. The throttling valve means 14 and 32 may be suitably operatively interconnected as through related linkage and motion transmitting means 36 to the operator positioned throttle control means which may be the operator foot-operated throttle pedal or lever 38 as usually provided in automotive vehicles.

Fuel supply conduit or passage means 40 may comprise, for example, a first metered fuel passage portion 42 communicating with a second unmetered fuel passage portion 46 leading as to related fuel pumping means 48 which receives its fuel as from associated fuel supply or reservoir means 50. Conduit or passage portion 42 is placed in communication with the discharge orifice means 28 as by suitable conduit means 52 effectively communicating between passage 42 and annulus 30. A valve seating surface 54 formed as within a chamber 53, is effective for cooperating with the valve surface 58 of a valving means 60 for opening and closing communication and flow through a first conduit segment 55. Further, passage means 40, as at a point downstream of chamber 53, is placed in communication with a source of ambient atmosphere as by conduit means 62 comprising calibrated restriction passage means 64.

Valving means 60 is illustrated as comprising a portion of an overall oscillator type valving means or assembly 63 which is depicted as comprising a spool-like bobbin 65 having inner passage means 66 slidably receiving therein valve member 60 and spring means 68 yieldingly urging valve member 60 generally toward the left and into seated engagement with valve seating surface means 54. A field or solenoid winding or coil 70 is carried by the bobbin 65 and has its opposite electrical ends connected as to electrical conductors 72 and 74 which may pass through suitable closure means 76 and be electrically connected as to related control means 78. The practice of the invention is not limited to, for example, a particular fuel metering means; however, as illustrated, the metering valving means 63 may be of the duty-cycle type wherein the winding 70 is intermittently energized thereby causing, during such energization, valve member 60 (which is the armature) to move in a direction away from valve seating surface means 54 to a position as generally depicted. As should be apparent, with such a duty-cycle type metering solenoid assembly the "effective flow area" immediately downstream of valving member surface 58 can be variably and controllably determined by controlling the frequency and/or duration of the energization of coil means 70.

The control means 78 may comprise, for example, suitable electronic logic type control and power output means effective to receive one or more parameter type input signals and in response thereto produce related outputs. For example, engine temperature responsive transducer means 80 may provide a signal via transmission means 82 to control means 78 indicative of the engine temperature; sensor means 84 may sense the relative oxygen content of the engine exhaust gases (as within engine exhaust conduit means 86) and provide a signal indicative thereof via transmission means 88 to control means 78; engine speed responsive transducer means 90 may provide a signal indicative of engine speed via transmission means 92 to control means 78 while engine load, as indicated for example by throttle valve 14 position, may provide a signal as via transmission means 94 to control means 78 A source of electrical potential 96 along with related switch means 98 may be electrically connected as by conductor means 100 and 102 to control means 78.

It can be seen that the metered fuel passage or conduit means 42 is illustrated as comprising calibrated passage means 55 in series with a downstream situated conduit section 57 which may comprise an enlarged chamber-like passage portion 59. As depicted, the conduit section 57 may extend upstream of enlarged passage portion 59 as to define, in effect, an extending portion 61 of passage or conduit section 57. The downstream end of metered fuel conduit section 57 communicates with inlet 52 leading as to the annulus 30 which, in turn, feeds the discharge port means 28.

The bleed air passage means 62, communicating as with the ambient, comprises calibrated restriction means 64 and such bleed air as is delivered into the metered fuel conduit means 42 is introduced as to have its general path flow generally perpendicular to the general path of flow of the metered fuel.

The fuel pressure regulator means 110 is illustrated as comprising housing means 112 formed as by an upper disposed housing section or portion 114 and a lower disposed housing section or portion 116 which are suitably secured to each other as to thereby generally peripherally sealingly secure a pressure responsive movable wall means or diaphragm 118 as to, in turn, define chambers 120 and 122. The upper chamber 120 may be considered the fuel chamber and is placed in communication with chamber 53 as by conduit means 46.

A valve actuating stem member 124 is operatively connected to diaphragm means 118 as through opposed diaphragm backing plates 126 and 128 by a peened portion 130. A spring 132, situated in chamber 122, has its upper end in operative engagement with diaphragm means 118 and its lower end situated as against a spring seat 134. The spring seat 134 may be adjustably positioned as by a cooperating screw means 136 which may also be provided with suitable cooperating sealing means (not shown) in order to prevent any fluid flow past screw or adjustment means 136 and out of chamber 122. Chamber means 122 is placed in communication with conduit means 40 as at a point downstream of calibrated passage means 55 as by conduit means 138 preferably comprising calibrated restriction means 140. It should be made clear that even though in the embodiment illustrated chamber means 122 is referenced to the pressure of the metered fuel downstream of where it was metered, chamber means 122 may be placed in communication with any selected or desired reference pressure. For example, conduit or passage means 138 could be placed in communication with a source of atmospheric pressure thereby making the interior of chamber means at a pressure magnitude reflective of such atmospheric pressure.

A ball valve member 142 serves to variably throttle the flow of fuel flowing from fuel pump means 48 through conduit means 144 and 146 into the chamber 148 generally containing ball valve 142. A spring 150, generally within chamber 148, continually urges ball valve 142 toward seated engagement with the cooperating valve seating portion of fuel inlet passage 152.

A guide-like means 154, situated as at the upper end of chamber 120 slidably receives and guides the generally upper portion of stem or valve actuator member 124 which is preferably provided with an upper extension 156 for engaging ball or throttling valve 142. The guide means 154 is provided with a plurality of apertures or passages 158 for the generally free flow of fuel therethrough and into chamber 120.

In the preferred embodiment of the invention a baffle means, such as, for example, a generally inverted conical or funnel-like member 160 is carried within chamber 120 generally between the throttling or regulator valve 142 and the fuel outlet 162 leading to passage 46. Such baffle means 160 serves to keep the fuel vapor, which may form, from the fuel supply conduit means 46.

A conduit means 164, which may comprise calibrated passage means 166, serves to operatively interconnect chamber 120 and the fuel tank or supply means 50 as to thereby be effective for returning any fuel vapors to the tank or reservoir means 50.

In the preferred embodiment of the invention the volumetric capacity of chamber 120 is approximately that as would usually be for a fuel bowl of a conventional carburetor thereby assuring that in the event the engine and the regulator means 110 experiences a prolonged hot-soaking (being exposed to high temperatures for an abnormally extended period of time) there will still remain a sufficient amount of fuel, within chamber means 120, to again start the associated engine 18.

Operation of Invention

First, without regard to the operation of the pressure regulating valve assembly 110, let it be assumed that the pumping means 48 delivers fuel under regulated, substantially constant pressure directly to conduit 46 and chamber 53 from where such fuel is metered by the metering function cooperatively defined by the valving surface 54, movable valve surface 58 and calibrated passage or restriction means 55 from where such metered fuel flows into metered fuel conduit means 42, through inlet passage 52 into annulus 30 and ultimately through discharge port means 28 and to the engine 18. The rate of metered fuel flow, in the structure disclosed, will be dependent upon the relative percentage of time, during an arbitrary cycle time or elapsed time, that the valve surface 58 is relatively close to or seated against valve orifice seat 54 as compared to the percentage of time that the valve surface 58 is relatively far away from the cooperating valve orifice seat 54. This, in turn, is dependent on the output to coil 70 from control means 78 which, in turn, is dependent on the various parameter signals received by the control means 78. For example, if the oxygen sensor and transducer means 84 senses the need of a further fuel enrichment in the motive fluid being supplied to the engine and transmits a signal reflective thereof to the control means 78, the control means 78, in turn, will require that the metering valve 60 be opened a greater percentage of time as to provide the necessary increased rate of metered fuel flow. The practice of the invention is not limited to a particular form of fuel metering means or to a particular system for the control of such fuel metering means. Accordingly, it will be understood that given any selected parameters and/or indicia of engine operation and/or ambient conditions, the control means 78 will respond to the signals generated thereby and respond as by providing appropriate energization and de-energization of coil means 70 (causing corresponding movement of valve member 60) thereby achieving the then required metered rate of fuel flow to the engine.

In the structure 10 disclosed during engine operation the velocity of bleed air flow through the calibrated air bleed restriction means 64 is at sonic condition while the rate of flow of solid (liquid) metered fuel from calibrated means 55 is at a sub-sonic condition. The high velocity bleed-air stream impinges upon and interacts with the lower velocity stream of fuel causing atomization of the fuel at the point of contact of such bleed-air and fuel streams. Such atomization also continues during the subsequent flow downstream of the point of contact to the discharge aperture means 28.

Chamber or enlargement 59 is provided as at the initial point of contact between the streams of bleed-air and liquid fuel provides additional space for the initial atomization of the fuel. That is, the increased space provided by the enlargement 59 in effect accommodates, at that point, the increased volume of the resulting air-atomized-fuel stream which is, of course, the product of the volume of the bleed-air stream and the atomized fuel. Causing the metered liquid fuel to expand (by having it enter the enlargement 59) and causing the bleed-air to also undergo expansion (by having it enter the enlargement 59) further enhances the overall atomization of the fuel.

The fuel atomization provided by structure 10 enables the effectively perfect fuel distribution as to a multicombustion chamber engine and achieving this in the entire range of engine operation while only having to employ relatively low pressure unmetered fuel. In the apparatus 10, during curb idle and a portion of the idle engine operation, the main air throttle means 14 may be generally fully closed while the auxiliary or idle air throttle valve means 32 is partly opened thereby requiring that generally all air-flow to the engine 18 pass through induction passage means 22. Such idle air flow passing through the venturi portion 26 of discharge nozzle means 24 produces a reduced pressure in the area of the fuel discharge port means 28 thereby further assisting in the flow of such atomized metered fuel into the stream of idle air flowing through the nozzle 24. As such fuel-atomized-air mixture passes from the nozzle 24 and into the main induction passage means 12, it undergoes a further and substantial expansion which, in turn, results in a further atomization and distribution of the fuel within the fuel-air mixture prior to its introduction into the engine 18.

As increased idle engine loads are experienced, the idle or auxiliary air throttle valve means 32 is further opened and eventually, with still further increasing engine loads, opening of the main air throttle means 14 is initiated. Such, in effect, staged opening of the auxiliary and main air throttle valves 12 and 14 may be accomplished by any suitable means including, for example, lost-motion connecting means (many of which are well known in the art) which may comprise a portion of the linkage or control means.

As also illustrated, the structure 10 may further comprise additional main venturi means 104 in the main induction passage means 12. In such an arrangement, the outlet end 108 of the discharge nozzle means 24 could be situated generally within the throat 106 of venturi means 104.

The foregoing was described, without reference to the fuel pressure regulator assembly 110, as if, somehow pressure regulated fuel was supplied directly to conduit 46.

Now referring to the drawing with specific consideration being given to the pressure regulator means 110, it can be seen that fuel pumping means 48 supplies fuel via conduit means 144 to conduit or passage 146 of housing means 112. Normally, the spring 132 and the pressure differential across the movable wall means or diaphragm means 118 will be such as to cause valve actuator 124 to be positioned upwardly a distance sufficient to unseat ball or throttling valve 142 thereby completing communication, as between chamber 148 and chamber 120 via passage means 152. The fuel thusly supplied flows into and fills chamber 120 from where it flows via conduit means 46 to chamber 53 for metering as previously described.

In the embodiment illustrated, chamber 122 is also filled by virtue of its connection with conduit means 40 via conduit means 138. As should now be apparent, the pressure drop or differential existing effectively across the calibrated passage 55 is communicated to chambers 120 and 122 with chamber 120 being at the pressure of upstream yet unmetered fuel in chamber 53 while chamber 122 is at substantially the pressure of the throat of the sonic venturi 26 which is downstream of the fuel metering function occurring as at passage 55 by valving surface 58.

From this it can be seen that the entire fuel pressure regulating function, accomplished by fuel pressure regulating means 110 is referenced to, in the main, the pressure at the throat of the sonic venturi 26. The calibrated restriction means 140 is provided mainly to serve as damping means to effectively prevent any sudden transient conditions to effect the magnitude of the pressure within chamber 122. However, as previously pointed-out, the fuel pressure regulating function can be referenced to any desired selected pressure as, for example, atmospheric pressure.

The pumping means 48 is selected as to, during all conditions of engine operation, provide a pump-output pressure greater than the regulated pressure so that a pressure drop (differential) always exists across the regulator valve 142.

As the pressure of the fuel in chamber 120 tends to increase, the differential caused thereby causes the diaphragm means 118 and valve actuator 124, 156 to move downwardly thereby permitting the throttling valve 142 to move at least more nearly closed against its cooperating seat about passage 152 thereby effectively increasing the pressure differential across throttling valve 142 thereby preventing the magnitude of the pressure within chamber 120 from increasing and maintaining the desired pressure differential across diaphragm means 118.

During certain conditions of engine and vehicular operation, such as, for example, when the vehicle is undergoing deceleration and the engine is being effectively driven by the vehicular ground-engaging drive wheel means, and, if the control means 78 is such as to require no fuel flow to the engine during such condition of operation, the valve actuator means 124, 156 would, because of the continued closure of metering valving means 63, assume a position as generally depicted in the drawing thereby permitting the full seating of regulator or throttling valve member 142.

In the preferred arrangement of employing the invention, the pumping means 48 would be of the generally conventional engine driven diaphragm type wherein the pump output pressure would be sufficient as to assure, for example, a regulated pressure within chamber 120 of a magnitude in the order of 10.0 p.s.i.

Accordingly, it can be seen that the invention enables the use of relatively inexpensive fuel pumping means and a resulting fuel injection system of relatively low unmetered fuel pressure whereas, in comparison, the prior art has usually required unmetered fuel pressures in the order of 40.0 p.s.i. in an attempt to obtain the required metering functions and the required fuel atomization.

Further, for example, as during hot engine shut-down, if any fuel vapors form such are vented through conduit means 164 and calibrated passage means 166. Such calibrated restriction means 166 is provided as to not impair the magnitude of the regulated pressure in chamber 120 during engine operation and yet provide a path for fuel vapor return to the fuel supply means 50 as at engine shut-down.

Although only a preferred embodiment and selected modifications of the invention have been disclosed and described, it is apparent that other embodiments and modifications of the invention are possible within the scope of the appended claims.

What is claimed is:

1. The combination of fuel metering apparatus for supplying metered rates of fuel flow to a combustion engine, fuel pressure regulating means and fuel pump means, wherein said fuel metering apparatus comprises body means, induction passage means formed through said body means for supplying motive fluid to said engine, said induction passage means comprising inlet means for permitting the inlet of air and first outlet means for discharging motive fluid to said engine, air throttle valve means for variably controlling the rate of flow of air through said induction passage means and into said engine, fuel metering means for metering liquid fuel in response to engine demands and indicia of engine operation, first fuel inlet means upstream of said fuel metering means for supplying unmetered fuel under superatmospheric pressure to said fuel metering means, metered fuel conduit means downstream of said fuel metering means for receiving metered fuel from said fuel metering means, said metered fuel conduit means communicating with said induction passage means through sonic discharge nozzle means, air passage means communicating between a source of air and said metered fuel conduit means, said air passage means being effective for commingling with said metered fuel in said metered fuel conduit means at a point upstream of said sonic discharge nozzle means, wherein said fuel pressure regulating means comprises first and second chamber means, pressure responsive movable wall means forming a common wall of and between said first and second chamber means, second fuel inlet means communicating with said first chamber means and said fuel pump means, fuel throttling valve means effective for throttling the flow of fuel from said fuel pump means to said first chamber means, said first chamber means being in fluid circuit with said first fuel inlet means, fluid pressure conduit means operatively interconnecting said second chamber means and said metered fuel conduit means, actuator means operatively connected to said pressure responsive movable wall means for operatively engaging said fuel throttling valve means as to be capable of causing said throttling valve means to move toward and away from a closed position, resilient means normally urging said actuator means in a direction whereby said actuator means would be effective for causing said fuel throttling valve means to move to a more fully opened position, second resilient means operatively connected to said fuel throttling valve means as to normally urge said fuel throttling valve means toward a closed position, return conduit means, said return conduit means communicating between said first chamber means and an area upstream of and in fluid circuit with said fuel pump means, and baffle means situated within said first chamber means as to serve to separate fuel vapors from the liquid fuel within said first chamber means and permit said fuel vapors to flow into said return conduit means.

2. A fuel pressure regulator assembly for regulating the pressure of fuel being supplied to associated fuel metering means downstream thereof, said fuel pressure regulator assembly comprising first and second chamber means, pressure responsive movable diaphragm means forming a common wall of and between said first and second chamber means, first inlet means for communicating between said first chamber means and associated fuel pumping means, passage means for supplying unmetered fuel at a regulated pressure from said first chamber means to said fuel metering means, fuel throttling valve means effective for variably throttling the flow of fuel at a superatmospheric pressure from said associated fuel pumping means to said first chamber means, fluid pressure transmitting passage means effective for communicating between said second chamber means and a source of reference pressure, actuator means operatively connected to said pressure responsive movable diaphragm means effective for operatively engaging said fuel throttling valve means as to be capable of causing said throttling valve means to move toward and away from a closed position, resilient means normally urging said actuator means in a direction whereby said actuator means would be effective for causing said fuel throttling valve means to move to a more fully opened position, return conduit means, said return conduit means being effective for communicating between said first chamber means and an area upstream of and in fluid circuit with said associated fuel pumping means, and baffle means situated within said first chamber means as to serve to separate fuel vapors from the fuel within said first chamber means and permit said fuel vapors to flow into said return conduit means.

3. A fuel pressure regulator according to claim 2 wherein during use said regulator is positioned as to have at least a major portion of said first chamber means at an elevation higher than said second chamber means.

4. A fuel pressure regulator according to claim 2 wherein said return conduit means communicates with said first chamber means at an upper portion thereof, and wherein said first inlet means communicates with said first chamber means at another upper portion thereof.

5. A fuel pressure regulator according to claim 2 wherein said return conduit means communicates with said first chamber means at a first upper portion thereof, wherein said first inlet means communicates with said first chamber means at a second upper portion thereof, and wherein said baffle means circumscribes both of said first and second upper portions.

6. A fuel pressure regulator according to claim 2 wherein said baffle means serves to define first and second chamber portions within said first chamber means, wherein said return conduit means and said first inlet means each communicates directly with said first chamber portion, wherein said flow of flue as is throttled by said throttling valve means flows into said second chamber portion after flowing through said first chamber portion, and wherein said passage means for supplying unmetered fuel at a regulated pressure communicates directly with said second chamber portion.

7. A fuel pressure regulator according to claim 2 wherein said baffle means is turbular and of a generally conical configuration, wherein said baffle means comprises first and second ends, wherein said first end generally circumscribes both said first inlet means and said return conduit means at locations where each of said first inlet means and said return conduit means communicates with said first chamber means, and wherein said actuator means extends through said second end of said baffle means.

* * * * *